United States Patent [19]

Cesa

[11] 4,006,729

[45] Feb. 8, 1977

[54] FIREPLACE

[76] Inventor: Valentin Cesa, 37 rue Eugene Meyzonnier, Annonay (Ardeche), France, 07100

[22] Filed: Mar. 4, 1975

[21] Appl. No.: 555,188

[30] Foreign Application Priority Data

Mar. 12, 1974 France ..... 74.09358

[52] U.S. Cl. ..... 126/121; 126/288; 126/293

[51] Int. Cl.[2] ..... F24B 1/18

[58] Field of Search ..... 126/121, 142, 293, 288; 237/51

[56] References Cited

UNITED STATES PATENTS

| | | | |
|---|---|---|---|
| 394,653 | 12/1888 | Jackson | 126/121 |
| 411,393 | 9/1889 | Peck | 126/121 |
| 1,987,252 | 1/1935 | Cage | 126/121 |
| 2,471,351 | 5/1949 | Russell | 237/51 X |
| 2,725,874 | 12/1955 | Payne | 126/121 |

*Primary Examiner*—William F. O'Dea
*Assistant Examiner*—Harold Joyce
*Attorney, Agent, or Firm*—Eric P. Schellin

[57] ABSTRACT

A wood burning fireplace in which exterior air is heated during flow through a chimney hood. Recirculated air from the room is drawn in and mixed with the heated fresh air in a zone formed between the chimney hood and a decorative hood casing. A linked damper arrangement is provided with one damper on the chimney pipe to control the fire draught and one on the fresh air inlet so that the amount of fresh air admitted is proportional to the amount of air extracted from the room.

3 Claims, 4 Drawing Figures

1
2
E
S
2

S

FIG. 4
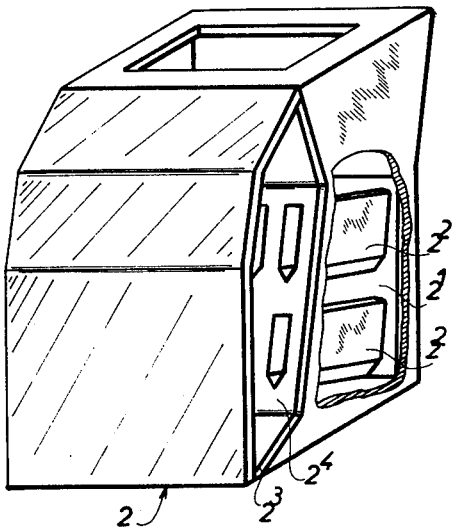
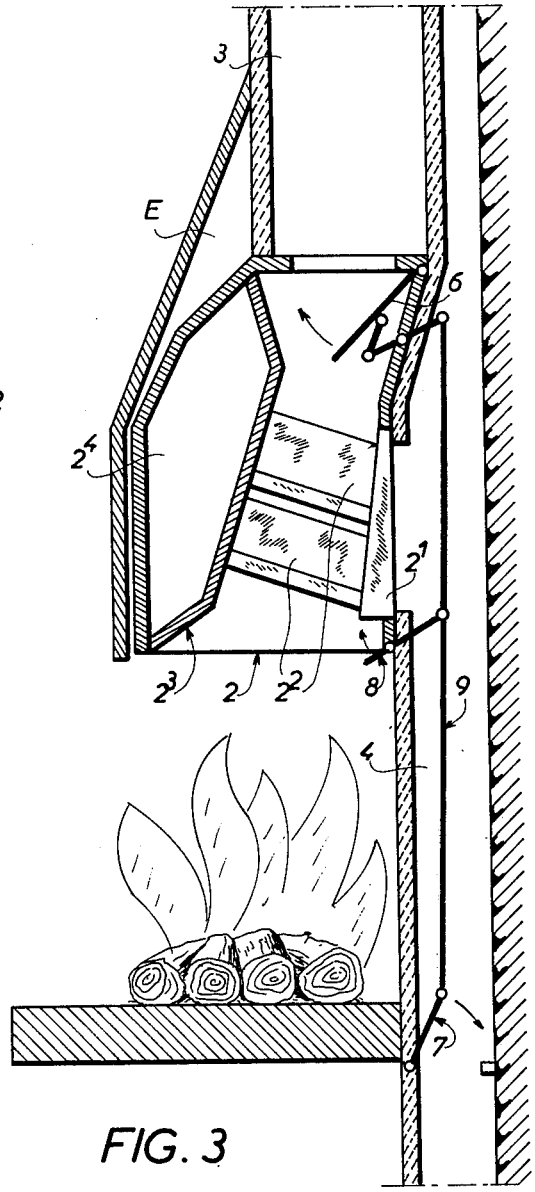
FIG. 3

FIREPLACE

BACKGROUND OF THE INVENTION

The present invention relates to combustion apparatus and in particular to a wood burning fireplace.

It is well known to provide wood burning fireplaces as decorative structure in a room. Difficulties caused by this type of apparatus include the presence of currents of cold air, fume emission and the provision of only a small amount of heat concentrated in the upper portions of a room. Further, in many cases such apparatus cannot readily be adjusted and is complex and intricate to install. Such types of fireplace are not provided with chimney dampers and the flow of heated air can never be completely shut off, which is why they are not compatible with electric heating.

SUMMARY OF THE INVENTION

To overcome these undesirable features, the fireplace of this invention includes the features that fresh air arriving at the base of the fireplace is heated in a convector positioned in the interior of a chimney hood placed above the hearthstone. The heated air is then diffused to the room environment through one or several holes in the surface of a decorative chimney casing which encloses the chimney hood. The diffusion of the heated air forms a zone of reduced pressure between the chimney hood and casing to induce further air from the room to flow from the base along vertical air passages placed at the side of the fireplace to the space formed between the hood and casing. This permits mixing of the heated air with the room air and its distribution throughout the room.

More specifically, the chimney hood contains a heater for the exterior air supplied from a shaft at the foot of the fireplace. It has two chambers, one connected to the fresh air shaft and the other communicating with holes for diffusing heated air into the room. These chambers are connected by a plurality of tubes of generally rectangular configuration heated by the fire. A chimney pipe connected to the upper part of the chimney hood removes the combustion products. Dampers are provided in the fresh air shaft and the chimney pipe, which can be simultaneously actuated by a lever placed in front of the fireplace. In an alternative arrangement several diffusion orifices may be positioned on the lateral faces or in front of the decorative chimney hood.

These characteristics and others will become apparent from the following description illustrating one particular embodiment of the invention.

BRIEF DESCRIPTION OF THE DRAWINGS

FIG. 3 is a side view, in cross section, particularly showing the arrangement for damping the chimney shaft; and FIG. 4 is a perspective view of the chimney hood.

DESCRIPTION OF THE PREFERRED EMBODIMENT

Figure 1:
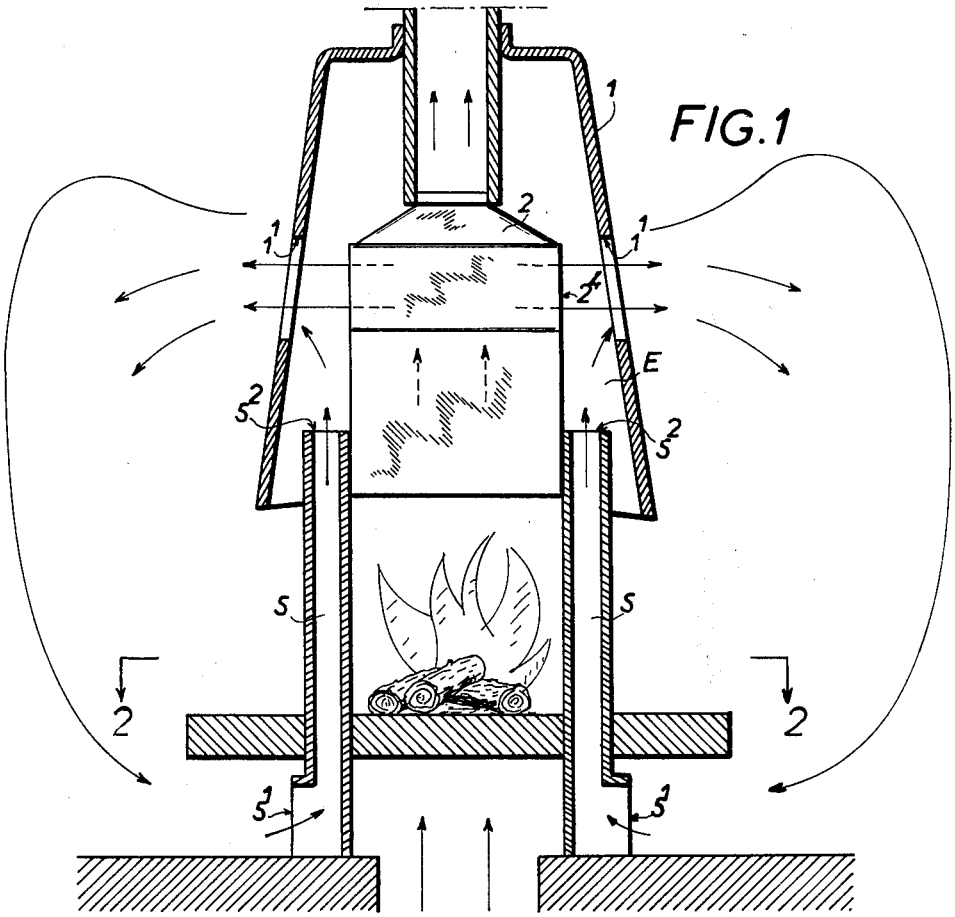
FIG. 1 is a rear elevation, in cross section, of the fireplace of the present invention showing the unobstructed circulation of heated air produced by it.
Figure 2:
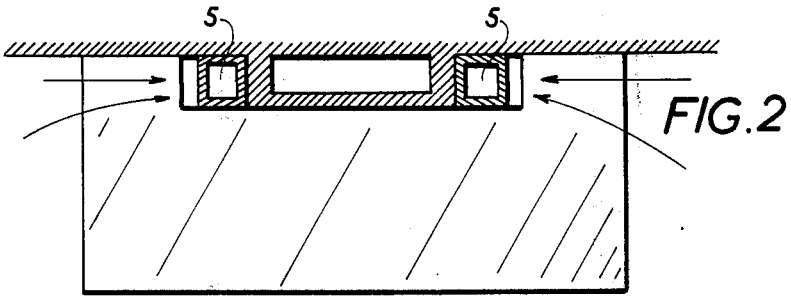
FIG. 2 is a plan view, in section, taken along the line 2—2 of FIG. 1.

In order to illustrate the present invention more completely, a specific embodiment will now be described with respect to the drawings, but it will be understood that the invention is not limited to this specific embodiment.

The wood burning fireplace is composed of a decorative chimney hood casing 1 covering a chimney hood 2 having its upper portion connected to a chimney pipe 3 for removal of the smoke. The hood 2 contains a chamber $2^1$ connected to a ventilation shaft 4 to provide fresh air from a basement or cellar or other suitable source. Tubes $2^2$ extend substantially perpendicular to the front surface of chamber $2^1$ and lead across the fire passage into a chamber $2^3$ formed in the interior of chimney hood 2. Openings $2^4$ are formed on the side faces of the chamber to provide for the diffusion of heated air into the space E formed between the chimney hood casing 1 and the chimney hood 2. Openings $1^1$ are positioned on the side faces of decorative chimney hood casing 1 in registration with openings $2^4$ to permit diffusion of heated air to the interior of the room containing the fireplace. Due to the passage of heated air into the space E, a partial vacuum is created to aspirate fresh air from the room ascending from base $5^1$ of vertical air passages 5 arranged at each side of the fireplace. The upper end $5^2$ of each passage 5 is positioned inside the space E formed between the chimney hood casing 1 and the chimney hood 2. This provides permanent mixing and recirculation of the air from the room. The heated air is circulated in all directions as much in the higher as the lower parts of the room, thus avoiding a layer of cold air at floor level.

It will be noted that tubes $2^2$ preferably are formed with generally rectangular configuration to assure an appropriate heat exchange surface with a minimum number of tubes. This does not, of course, exclude the use of tubes of different cross section in other embodiments. These tubes are fixed to chamber $2^1$ by soldering or other suitable means.

In one embodiment of the invention, chimney pipe 3 and shaft 4 can be provided with dampers 6 and 7 controlled by a handle 8 placed at the front of the fireplace and connected to the dampers by a rod system 9. By means of this particular linkage the damper system is not affected by expansion due to heat and ensures admission of a suitable amount of fresh air proportional to the air evacuated while staying air tight in the closed position. The arrangement of the fireplace provides support members which may be threaded with bolts to be securely fastened to the wall. The arrangement also permits the storage of wood in the space formed under the hearthstone.

Significant advantages of the disclosed apparatus are as follows. It is simple to assemble and may be installed rapidly. The installation cost is low since the chimney hood does not need to be assembled. Control of draught with the inlet and outlet dampers is simple and can be extremely air tight. The heat output is increased because of a more effective heating surface and convection from the base. It achieves the diffusion of heated air through all the room including the floor level. Different models of the fireplace may have openings on three faces, or be fitted into a corner or be free standing between two rooms, etc. It is possible to store wood under the hearthstone.

The invention is not limited to this particular embodiment as obvious variations will be apparent. The present invention includes all such variations.

I claim:

1. A fireplace for the heating of fresh exterior air and the recirculation of room air comprising:

a. a chimney hood casing having first openings communicating with a room;

b. a chimney hood within the chimney hood casing having second openings in registration with said first openings communicating with said casing;

c. vertical air circulating passages communicating at a lower end with said room and at an upper end with the interior of said casing, wherein a flow of air from said second openings through said first openings into said room causes a reduced pressure within said casing to induce a flow of air from said room through said passages into said casing and through said first opening;

d. a first chamber supplied with fresh exterior air by a passage and a second chamber within said hood;

e. heating tubes within said hood between said first and second chambers, said heating tubes being generally rectangular in cross section;

f. a chimney pipe connected to said hood for the evacuation of fumes, said pipe communicating with a portion of said hood containing said heating tubes; and g. a plurality of dampers connected for interrelated control including a first damper located in the fresh exterior air supplying passage and a second damper located between the portion of said hood containing the heating tubes and the chimney pipe, whereby the amount of fresh exterior air supplied to said first chamber may be maintained in direct proportion to the amount of air evacuated by said chimney pipe.

2. A fireplace for the heating of fresh exterior air and the recirculation of room air comprising:

a. a chimney hood casing having a plurality of first openings communicating with said room;

b. A chimney hood within the chimney hood casing having second openings in registration with said first openings communicating with the interior of said casing;

c. a first chamber for receiving fresh air and a second chamber within said hood;

d. heating tubes within a portion of said hood joining said first and second chambers for the flow of fresh air therebetween, said heating tubes being generally rectangular in cross section;

e. a shaft for supplying fresh air to said first chamber and a chimney pipe for evacuating said portion of said hood;

f. a first damper located in said shaft and a second damper located between the portion of said hood and the chimney pipe; and g. means for interconnecting said dampers for simultaneous control whereby the amount of fresh air supplied to said first chamber may be maintained in direct proportion to the amount of air evacuated by said chimney pipe.

3. The fireplace of claim 2 further including:

a. vertical air circulating passages communicating at a lower end with said room and at an upper end with the interior of said casing, said upper end located below the first openings of said chimney hood casing and the second openings of said chimney hood, wherein a flow of fresh air from said shaft to said first chamber through said tubes into said second chamber and through said first and second openings creates a reduced pressure in the region of the vertical air passage upper end, the reduced pressure drawing room air into said lower end, through said passage and into said casing interior to mix with said fresh air and be expelled through said first openings.

* * * * *